US006438443B1

(12) United States Patent
Berghs et al.

(10) Patent No.: US 6,438,443 B1
(45) Date of Patent: Aug. 20, 2002

(54) METHOD AND DEVICE FOR PRE-SETTING THE PLANENESS OF A ROLLER STRIP

(75) Inventors: Andre Berghs, Neunkirchen; Hao Yuan, Erlangen, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/381,725

(22) PCT Filed: Mar. 16, 1998

(86) PCT No.: PCT/DE98/00774

§ 371 (c)(1),
(2), (4) Date: Sep. 24, 1999

(87) PCT Pub. No.: WO98/43755

PCT Pub. Date: Oct. 8, 1998

(30) Foreign Application Priority Data

Mar. 27, 1997 (DE) ..... 197 13 004

(51) Int. Cl.[7] ..... G06F 19/00
(52) U.S. Cl. ..... 700/148; 700/48
(58) Field of Search ..... 700/148, 149, 700/150, 151, 152, 153, 154, 155, 156, 48, 49, 29, 30, 31, 45, 47

(56) References Cited

U.S. PATENT DOCUMENTS

| | | | | |
|---|---|---|---|---|
| 3,733,878 A | * | 5/1973 | Anderson et al. | 72/243.6 |
| 4,691,548 A | * | 9/1987 | Richter et al. | 72/14.1 |
| 4,750,343 A | * | 6/1988 | Richter et al. | 72/11.4 |
| 4,805,433 A | * | 2/1989 | Rennebaum | 72/242.2 |
| 5,267,170 A | * | 11/1993 | Anbe | 700/154 |
| 5,493,885 A | * | 2/1996 | Nomura et al. | 72/9.1 |
| 5,513,097 A | * | 4/1996 | Gramckow et al. | 700/48 |
| 5,966,682 A | * | 10/1999 | Gramckow et al. | 702/170 |

FOREIGN PATENT DOCUMENTS

| | | |
|---|---|---|
| DE | 43 38 615 | 5/1995 |
| DE | 195 03 363 | 9/1995 |
| EP | 0 460 892 | 12/1991 |

OTHER PUBLICATIONS

Patent Abstracts of Japan, vol. 016, No. 467 (M–1317), Sep. 29, 1992 & JP 04 167908 (Toshiba Corp) Jun. 16, 1992.

Patent Abstracts of Japan, vol. 096, No. 012, Dec. 26, 1996 & JP 08 197120 (Kawasaki Steel Corp) Aug. 6, 1996.

Patent Abstracts of Japan, vol. 018, No. 613 (M–1709), Nov. 22, 1994 & JP 06 238311 (Sumitomo Metal Ind Ltd.) Aug. 30, 1994.

Patent Abstracts of Japan, vol. 011, No. 044 (M–560) Feb. 10, 1987 & JP 61 209708 (Mitsubishi Heavy Ind. Ltd; others) Sep. 18, 1986.

Patent Absracts of Japan, 07265927, Oct. 17, 1995, Kawasaki Steel Corp.

J. Tellman, "Improving Crown Performance of a Hot Strip Mill," Iron and Steel Engineer, Dec. 1995 pp. 21–26.

J. Robinson, "Effect of Back–up Roll Wear on Operation and Strip Shape of a CVC Cold Mill," Iron and Steel Engineer, Jun. 1996 pp. 15–19.

D. Auzinger, et al., "Neue Entwicklungen bei Prozessmodellen für Warmbreitbandstrassen," Stahl und Eisen 116 (1996) Nr. 7, Jul. 15, 1996*.

* cited by examiner

*Primary Examiner*—Leo Picard
*Assistant Examiner*—Chad Rapp
(74) *Attorney, Agent, or Firm*—BakerBotts LLP

(57) ABSTRACT

A method of presetting the roll nip profile of a roll stand for rolling a rolled strip is provided. The roll nip profile is influenced by output values for the roll nip profile and the tensile stress distribution being set over the roll nip profile. The output values for the roll nip profile is determined by using a roll nip profile model which calculates the roll nip profile. The calculated roll nip profile or an equivalent quantity is linked to a correction value, in particular by addition or multiplication, to form a corrected calculated roll nip profile, so that the roll nip profile model is adapted to the actual roll nip profile of the roll stand by using the correction value.

15 Claims, 1 Drawing Sheet

METHOD AND DEVICE FOR PRE-SETTING THE PLANENESS OF A ROLLER STRIP

FIELD OF THE INVENTION

The present invention relates to a method and a device for presetting the flatness of a rolled strip by presetting the roll nip profile of a roll stand for rolling a rolled strip, with the roll nip profile being influenced by output values for the roll nip profile and the tensile stress distribution being set over the roll nip profile, with the output values for the roll nip profile being determined by using a roll nip profile model which calculates the roll nip profile.

BACKGROUND INFORMATION

To prevent unevenness in rolling, in particular in cold rolling, influences that would interfere with the required roll nip profile must be counteracted by appropriate setting of the flatness control elements. Until the flatness control used for this purpose has reached a steady state, a lower-quality rolled product known as deviation is produced.

SUMMARY

To minimize this deviation and to make the rolling operation more reliable, the object of the present invention is to adjust the mill train so that the rolled strip will have the proper flatness from the beginning. To do so, a presetting function is required. This should determine the cumulative crown, i.e., the roll nip profile, as accurately as possible in advance at the start of a roll pass, i.e., when the strip to be rolled is entering the roll stand, and it should adjust the flatness control elements accordingly.

This object is achieved according to the present invention by providing a method and a device for presetting the roll nip profile of a roll stand for rolling a rolled strip, where the roll nip profile is influenced by output values for the roll nip profile. The tensile stress distribution over the roll nip profile is influenced. The output values for the roll nip profile are determined by using a roll nip profile model which calculates the roll nip profile, with the calculated roll nip profile or an equivalent quantity being linked to a correction value to form a corrected calculated roll nip profile. The roll nip profile model is adapted to the actual roll nip profile of the roll stand by using a correction value. It has been found that especially accurate presetting of the roll nip profile is achieved by using this method.

In an example embodiment of the present invention, the corrected calculated roll nip profile and the actual roll nip profile are compared, a new updated correction value being determined on the basis of this comparison, in particular by weighting with a learning function.

In another example embodiment of the present invention, the actual roll nip profile is determined from values, in particular measured values, for the tensile stress distribution. This determination of the actual roll nip profile from the tensile stress distribution is an especially suitable method of determining the roll nip profile.

In a particularly example embodiment of the present invention, the roll nip profile is first set when the rolled strip enters the stand according to the output values for the roll nip profile calculated by using the roll nip profile model. The roll nip profile is then set according to output values for the roll nip profile calculated by a flatness control. The flatness control assumes the function of setting the output values after measured values for the tensile stress distribution are available and after the flatness control has reached a steady state. Although the roll nip profile is set by the flatness control, the correction factor for the roll nip profile model is calculated anew. The same measured values are used for the tensile stress distribution as for the flatness control. In this way, the roll nip profile model can be corrected without any additional measured values. Another advantage is that many measured values are available for correction of the roll nip profile model, so that an especially good correction of the roll nip profile model is achieved.

DETAILED DESCRIPTION

Figure 1:
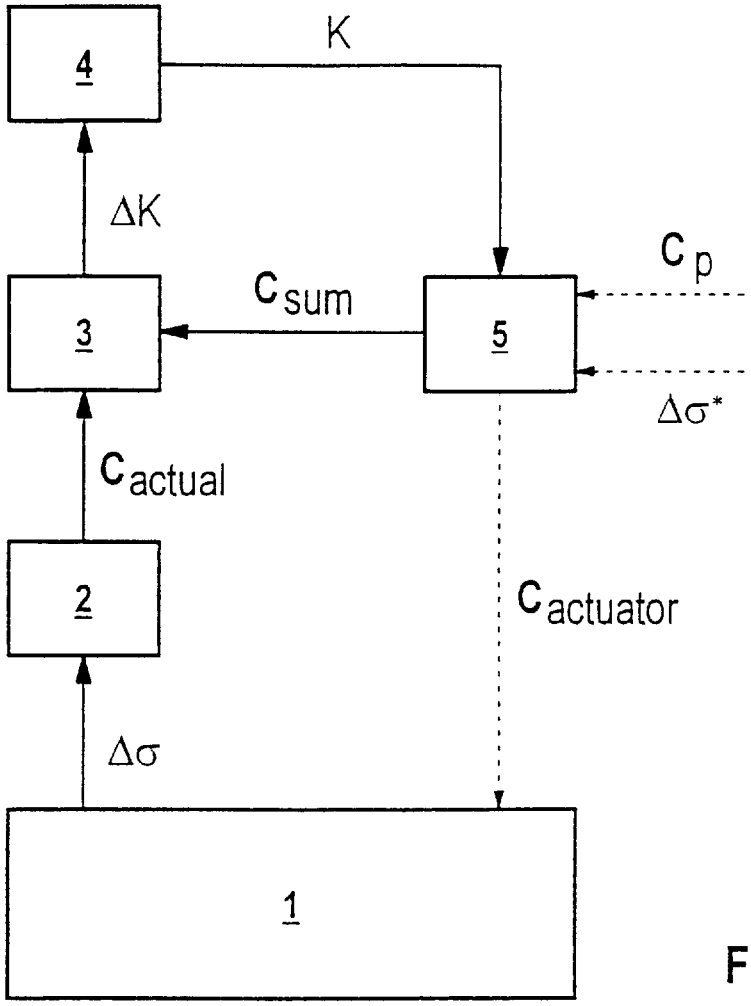
FIG. 1 shows a functional sequence of the method according to the present invention for presetting the roll nip profile.

FIG. 1 shows the sequence of the method according to the present invention for presetting the roll nip profile. On feed of a rolled strip into roll stand 1, the roll nip profile is at first set according to output values $c_{actuator}$ for the roll nip profile. Output values $c_{actuator}$ are determined by using roll nip profile model 5 as a function of a given strip profile $c_p$ and of setpoints $\Delta\sigma^*$ for the tensile stress distribution. To achieve an especially accurate presetting of the roll nip profile, roll nip profile model 5 is adapted to the actual roll nip profile. To do so, first tensile stress distribution $\Delta\sigma$ is measured. An instantaneous strip profile $c_{actual}$ is determined from tensile stress distribution $\Delta\sigma$ by using a strip profile determination 2. This instantaneous strip profile is compared by a comparator 3 with a corrected calculated roll nip profile $c_{sum}$ determined by using roll nip profile model 5. The function value of comparator 3 is a value $\Delta\sigma$ which is a measure representing how a correction value k for adapting roll nip profile model 5 to the actual roll nip profile is adapted. Correction value k is adapted by using a correction value determination 4.

The data flows shown with dotted lines in FIG. 1, i.e., $c_p$, $\Delta\sigma^*$ and $c_{actuator}$ are based on the presetting of roll stand 1.

Figure 2:
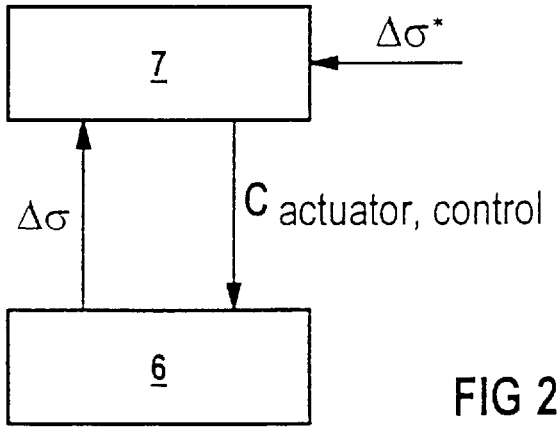
FIG. 2 shows a flatness control according to the present invention.

The data flows shown with solid lines, i.e., data flows for $\Delta\sigma$, $c_{actual}$, $c_{sum}$, $\Delta k$ and k, are based on adaptation of roll nip profile model 5. This training takes place when the roll nip profile is controlled. FIG. 2 illustrates such a control. In particular, FIG. 2 shows a roll stand 6 whose roll nip profile is adjusted according to output values $c_{actuator,control}$ as a function of tensile stress distribution $\Delta\sigma$ and setpoint tensile stress distribution $\Delta\sigma^*$ by using flatness control 7.

The function sequences shown in FIGS. 1 and 2 are explained below in greater detail.

The object of flatness control is to adjust all the actuators that influence the roll nip profile in such a way as to achieve a strip stress distribution over the width of the strip corresponding as closely as possible to the required setpoint curve. The various influencing factors, also known as actuator efficiencies, of the individual actuators on the roll nip profile are also be taken into account.

In addition to the actuators, there are several other influencing factors whose effect on the roll nip should be compensated by the actuators. These influences include:

- mechanical crown $c_m$, i.e., the mechanical camber due to roll grind
- wear crown $c_w$, i.e., roll abrasion
- temperature crown $c_t$, i.e., deformation of the rolls due to a change in thermal condition
- crown $c_{fr}$ of the set of rolls due to the roll separating force, i.e., the sagging of the rolls due to the roll separating force acting on the supporting rolls predetermined strip profile $c_p$, i.e., the cross-sectional shape of the hot strip.

Some of these can be determined only by approximation. The sum of these values, taking into account the different signs due to the direction of the effect acting in the roll nip, added to or multiplied by a correction value k, yields the crown model used according to the present invention. It is essentially true that all the components are additively superimposed in the roll nip, and a modeled roll nip $c_{sum}$ is obtained accordingly by the equation:

$$c_{mod}=-c_m+c_w-c_t+c_{fr}+c_p+k$$

where $c_m$ is the mechanical crown (roll grind) which is, a constant between two roll changes;

$c_w$ is the wear crown (roll abrasion) which depends depending on the rolled strip length and the roll separating force;

$c_t$ is the temperature crown (deformation due to change in thermal condition) as a function of time;

$c_{fr}$ is the crown of the set of rolls due to the roll separating force (deformation due to the roll separating force acting on the supporting rolls) as a function of time;

$c_p$ Is the predetermined strip profile (cross-sectional shape of the hot strip).

An approximate value $c_{Sum,ps}$ for the crown to be preset can be calculated from the setpoint curve and the system influences determined by approximation. This preset crown is referred to below as the sum crown.

$$c_{sum}=c_{sp}+c_{mod}=c_{sp}-c_m+c_w-c_t+c_{fr}+c_p+k$$

where $c_{sp}$ is the crown from the setpoint curve. It represents the desired stress distribution of the strip. The setpoint curve does not contain the strip shape correction, i.e., $c_{sp}=f(\Delta\sigma^*)$.

In this equation, $c_{sum}$ is used as preset value $c_{actuator}$ for setting the flatness control elements. This manipulated variable is the same as that used with active control for this function.

With $c_{actuator}$ the output values for the flatness control elements are determined. Relationships of the following form hold:

$$c_{acatuator}=ef_{1,ps}^{*}\ sp_{1,ps}+ef_{2,ps}+sp_{2,ps}+\ldots+ef_{n,ps}^{*}sp_{n,ps}$$

where $ef_{i,ps}$ are the efficiency factors of the actuators at the time of the presetting; these are to be determined from instantaneous strip data, $sp_{i,ps}$ are the output values to be preset.

A $c_{actuator}$ can be achieved at i>1 through an infinite number of combinations of output values.

Therefore, algorithms that yield the output value combinations with expedient strategies are used to find suitable output value combinations to achieve $c_{actuator}$. The rapid actuator for bending is thus set at a positive value so that this actuator has sufficient reserve control in the direction of both positive and especially negative bending. This value is abandoned only if the crown to be set, i.e., the roll nip profile, cannot be achieved in this way.

As in presetting of the crown to be set, the actual crown can be calculated as the sum crown during the rolling operation. This sum crown depends on time t and on the thermal condition of the roll stand:

$$c_{sum}(t)=c_{sp}(t)+c_{mod}(t)=c_{sp}(t)-c_m+c_w(t)+c_t(t)+c_{fr}(t)+c_p+k(t)$$

where

| | |
|---|---|
| $c_m$ | the mechanical crown (roll grind) is constant between two roll changes |
| $c_w(t)$ | the wear crown (roll abrasion) depends on the rolled strip length and the roll separating force |
| $c_t(t)$ | the temperature crown (deformation due to a change in thermal condition) as a function of time |
| $c_{fr}(t)$ | the crown of the set of rolls due to the roll separating force (deformation due to the roll separating force acting on the supporting rolls) as a function of time |
| $c_p$ | the predetermined strip profile (cross-sectional shape of the hot strip) is constant during a pass |
| k(t) | the previous correction value. |

With active control, the actuators are constantly re-optimized by the flatness control. Instantaneous output values $sp_i(t)$ are known. From these, sum crown $c_{actuator}$ (t) set instantaneously by the controller can be determined by using the equation:

$$c_{actuator}(t)=ef_1(cd^*sp_1(t)+ef_2(cd)^*sp_2(t)+\ldots+ef_n(cd)^*sp_n(t).$$

The actual roll nip crown is determined on the oasis of the instantaneous stress distribution in the strip, which is measured constantly by a stress measurement device. The equation for this determination from the strip stress distribution is:

$$c_{actual}(x)=\Delta\sigma(x)*\frac{h_{strip}}{E}+c_p(x)$$

where

| | |
|---|---|
| x | the position of a stress measurement point over the strip width |
| $\Delta\sigma(x)$ | strip stress deviation at point x of the strip width at the average tensile stress |
| $h_{strip}$ | strip thickness |
| E | modulus of elasticity of the strip material |

Thus, the actual crown is available as a vector $c_{actual}$. The value determined with the sum crown can then be compared with the actual crown. This yields the error in the model crown.

$$\Delta k=c_{actual}(t)-c_{sum}(t)$$

Correction value k contained in $c_{sum}(t)$ can thus be optimized. To obtain values for k that are independent of measurement errors and as reliable as possible, k is learned gradually with the help of an integral controller:

$$k=k+V_{LEARN}^{*}\Delta k$$

$V_{LEARN}$ is the setting parameter for the learning rate. $V_{LEARN}$ is preferably 0.01 to 0.1.

Learning of the correction value is performed approximately every ten seconds, for example, in active control.

Correction value k turns out very differently as a function of such strip and roll stand data as strip thick strip width, working roll diameter and roll separating force. However, the exact functional relationships are not known, so k(t) must be learned for a number of fixed individual supporting values; interpolation values are used for values between these learned values.

Conversely, correction value k(t) for the closest supporting values is to be learned for intermediate values. This must take place with weighting according to the distance from the intermediate value to the supporting value. Thus, interpolation is performed in both learning and querying.

The relationships, variables and equations presented here are each based on a position x over the width of the material strip, so they are a function f(x).

What is claimed is:

1. A method of presetting a roll nip profile of a roll stand for rolling a rolled strip, comprising:

determining an actual roll nip profile of the roll stand from measured values of a tensile stress distribution;

determining a calculated roll nip profile using a roll nip profile model;

linking the calculated roll nip profile to a correction value to form a corrected calculated roll nip profile to adapt the roll nip profile model to the actual roll nip profile of the roll stand using the correction value;

determining first output values for the roll nip profile using the adapted roll nip profile model;

setting the roll nip profile as a function of the first output values; and setting the tensile stress distribution over the roll nip profile.

2. The method according to claim 1, further comprising:

comparing the corrected calculated roll nip profile to the actual roll nip profile; and updating the correction value as a function of the comparison, the function including a weighting with a learning function.

3. The method according to claim 1, wherein the linking step includes linking the calculated roll nip profile to the correction value using one of addition and multiplication.

4. The method according to claim 1, wherein the setting the roll nip profile step includes setting the roll nip profile when a rolled strip enters the roll stand, and further comprising:

resetting the roll nip profile using second output values determined by a flatness control.

5. The method according to claim 1, wherein the roll nip profile is set one of: i) after determining the measured values for the tensile stress, and ii) after a roll nip controller has reached a steady state according to second output values for the roll nip profile determined by a roll nip profile controller.

6. The method according to claim 2, wherein the correction value is updated while the roll nip profile is set according to second output values for the roll nip profile determined by a roll nip profile controller.

7. The method according to claim 1, further comprising:

determining the first output values as a function of setpoints for the tensile stress distribution.

8. The method according to claim 1, further comprising:

determining the output values as a function of a predetermined strip profile of a rolled strip.

9. The method according to claim 1, wherein the first output values include the corrected calculated roll nip profile.

10. The method according to claim 1, wherein the roll stand is a complex roll stand having at least four rolls.

11. The method according to claim 10, wherein the roll stand includes twenty rolls.

12. The method according to claim 1, wherein the roll nip profile model includes at least one of the following parameters: i) roll grind, ii) roll abrasion, iii) deformation of the roll nip to due a change in temperature, iv) deformation due to a roll separating force acting on supporting rolls, and v) a predetermined strip profile.

13. The method according to claim 11, wherein a roll grind is a mechanical crown, a roll abrasion is a wear crown, the deformation of the roll nip due to a change in temperature is a temperature crown, the deformation due to the roll separating force acting on a supporting roll is crown of the roll nip, and the predetermined strip profile is a cross-sectional shape of a rolled strip entering the roll stand.

14. The method according to claim 13, wherein the corrected calculated roll nip profile is determined according to the following equation:

$$c_{sum}=c_p-(-c_m+c_w-c_t+c_{fr}+k)$$

where $c_m$ is the mechanical crown;

$c_w$ is the wear crown;

$c_t$ is the temperature crown;

$c_{fr}$ is crown of the roll nip;

$c_p$ is the predetermined strip profile; and k is the correction value.

15. A device for presetting a roll nip profile of a roll stand for rolling a rolled strip, comprising:

a first arrangement determining an actual roll nip profile of the roll stand from measured values of a tensile stress distribution;

a roll nip profile model determining a calculated roll nip profile;

a computing device linking the calculated roll nip profile to a correction value to form a corrected calculated roll nip profile to adapt the roll nip profile model to the actual roll nip profile of the roll stand using the correction value;

a second arrangement determining first output values for the roll nip profile using the adapted roll nip profile model;

a third arrangement setting the roll nip profile as a function of the first output values; and a fourth arrangement setting the tensile stress distribution over the roll nip profile.

* * * * *